United States Patent [19]

Grimshaw et al.

[11] 4,001,916

[45] Jan. 11, 1977

[54] FEED MECHANISMS FOR FIBER PROCESSING MACHINES

[75] Inventors: Keith Grimshaw, Todmorden; Roy Taylor, Oldham, both of England

[73] Assignee: The English Card Clothing Company, Ltd., Yorkshire, England

[22] Filed: Oct. 21, 1974

[21] Appl. No.: 516,581

[30] Foreign Application Priority Data

Nov. 10, 1973 United Kingdom ..... 52292/73

[52] U.S. Cl. ..... 19/96; 19/105

[51] Int. Cl.[2] ..... D01H 15/40

[58] Field of Search ..... 19/98, 99, 105, 106 R, 19/104, 83, 96, 88

[56] References Cited

UNITED STATES PATENTS

| | | | |
|---|---|---|---|
| 620,089 | 2/1899 | Threlfall | 19/105 |
| 1,441,895 | 1/1923 | Upchurch | 19/105 |
| 1,559,475 | 10/1925 | Thoma | 19/105 |

FOREIGN PATENTS OR APPLICATIONS

| | | | |
|---|---|---|---|
| 2,324 | 8/1877 | Germany | 19/88 |
| 7,733 | 1838 | United Kingdom | 19/105 |

*Primary Examiner*—Dorsey Newton

*Attorney, Agent, or Firm*—Norris & Bateman

[57] ABSTRACT

Fiber processing machinery including feed plates, carding plates and web strippers wherein means are provided for carefully adjusting the relative settings of adjacent components of such plates and strippers.

5 Claims, 12 Drawing Figures

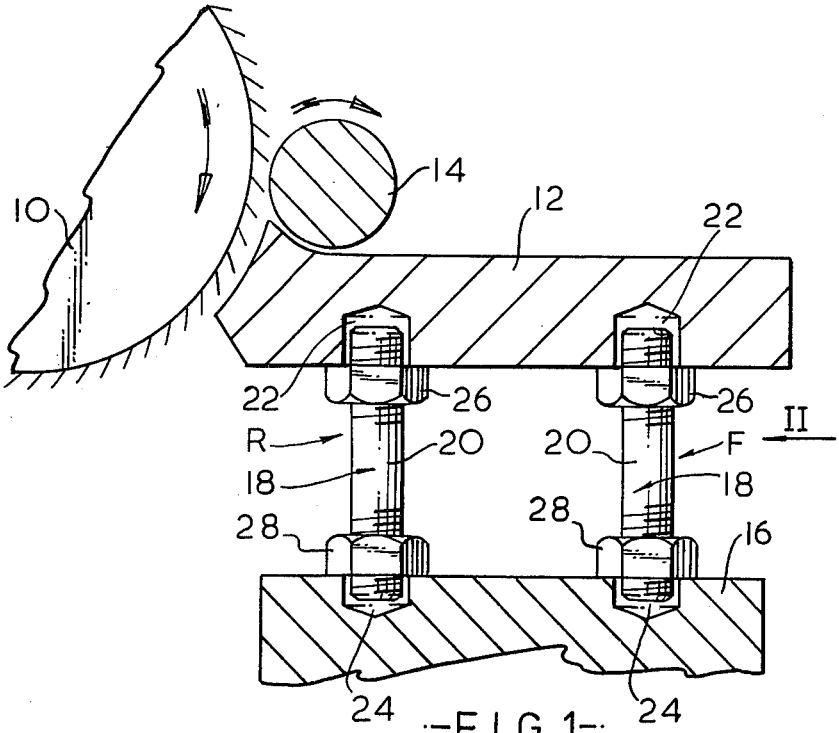
-FIG. 1-
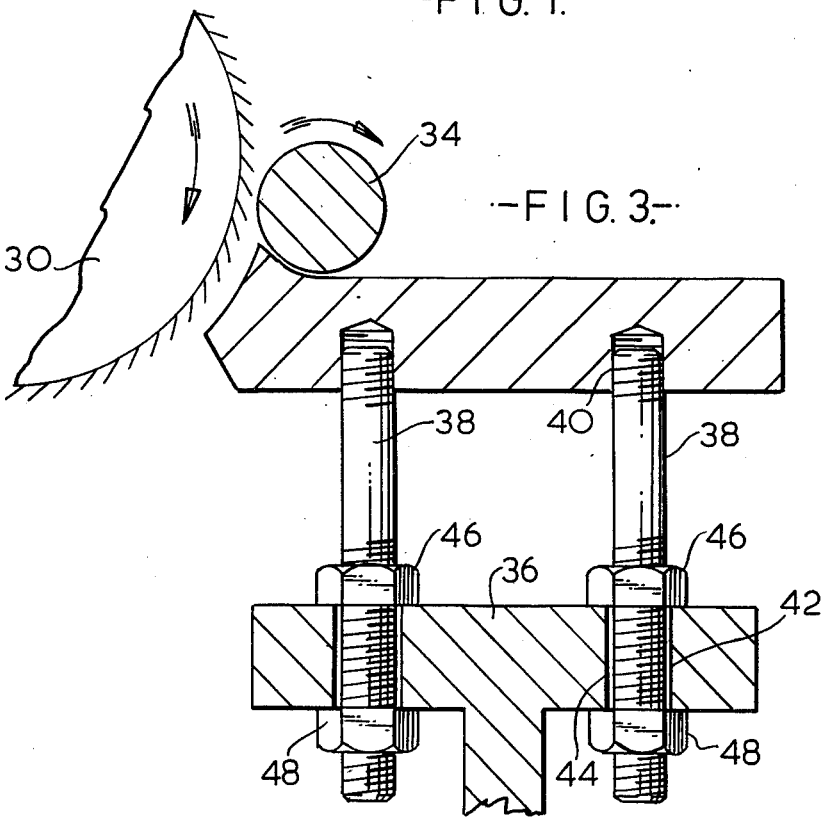
-FIG. 3-

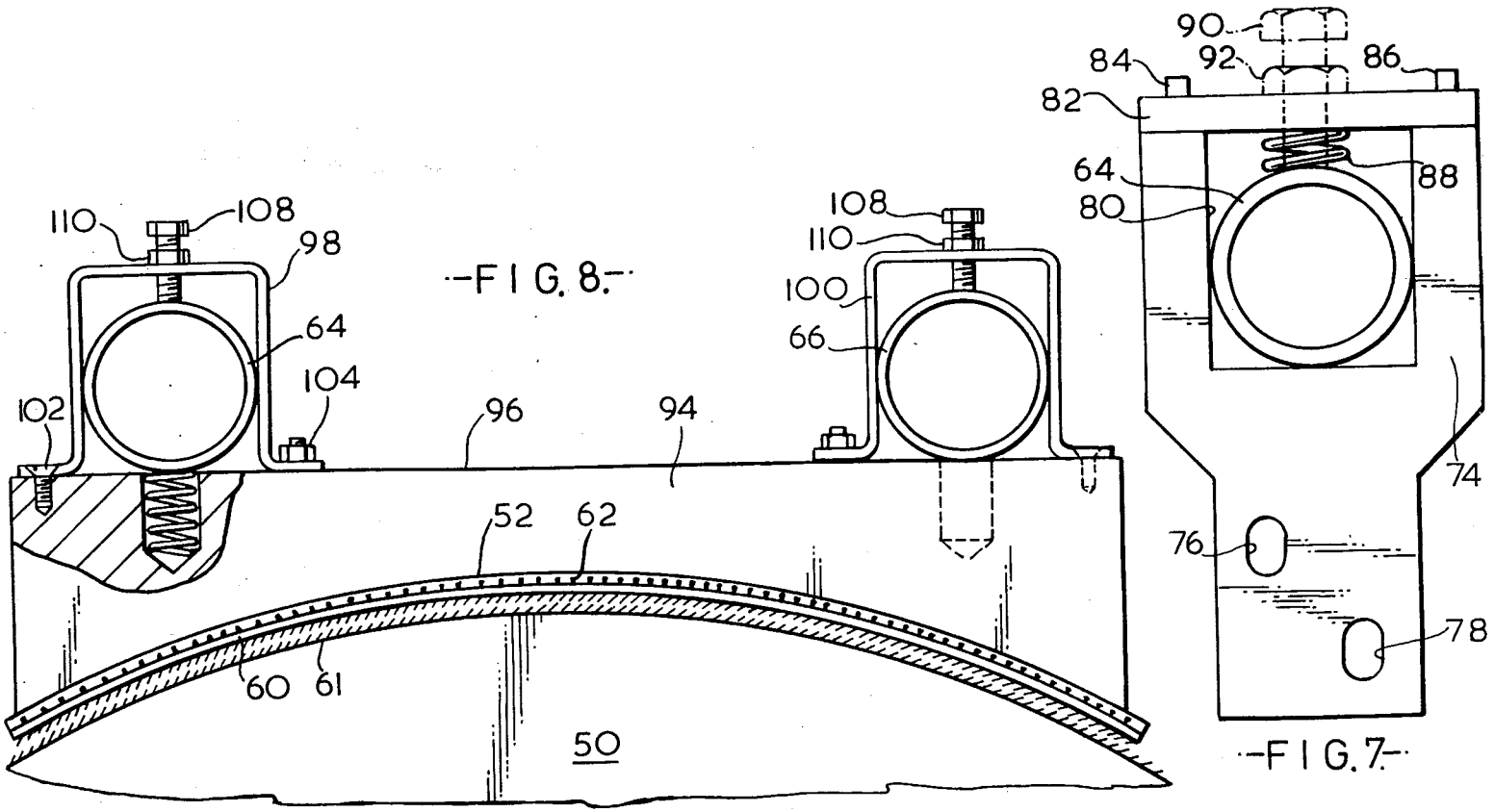
-FIG. 7.-
-FIG. 8.-

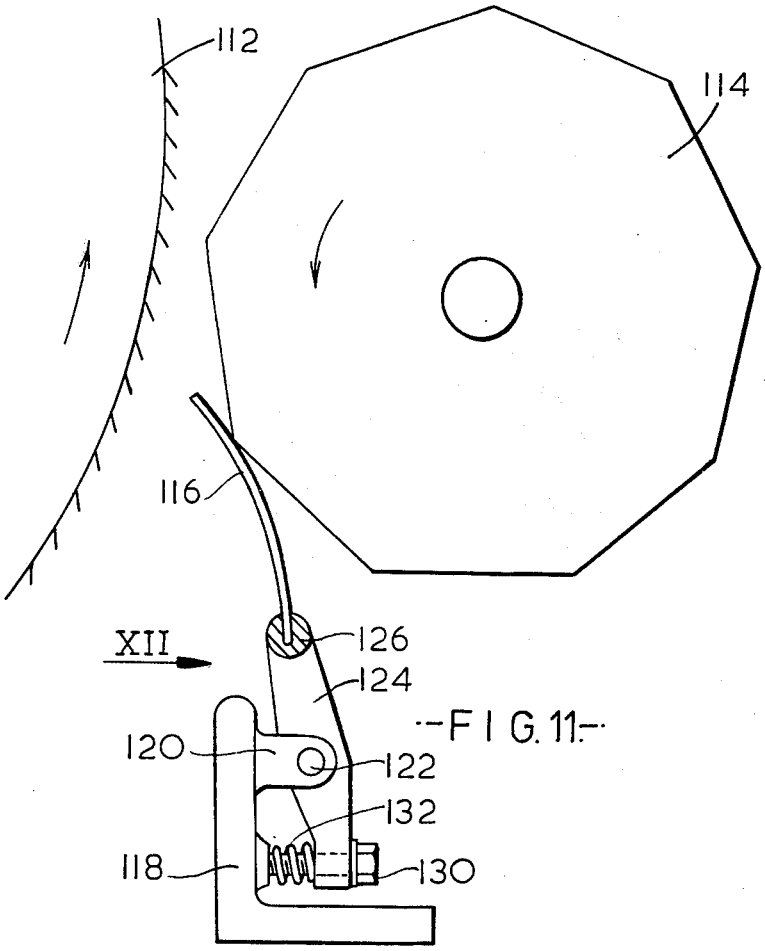
--FIG. 11--
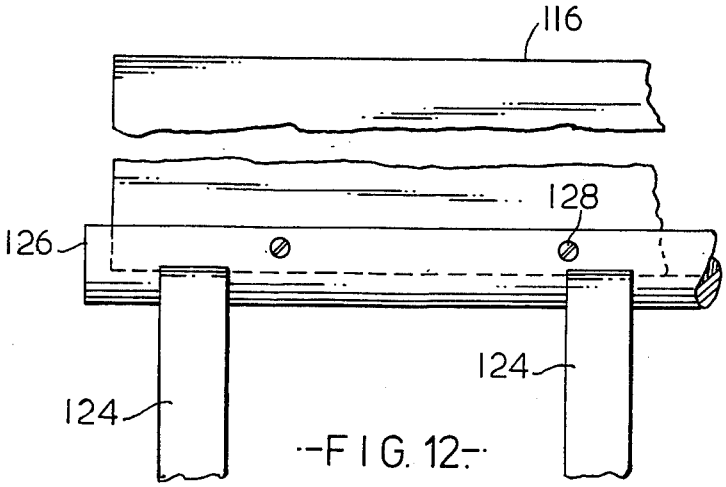
--FIG. 12--

FEED MECHANISMS FOR FIBER PROCESSING MACHINES

The present invention is concerned with fibre processing machines of the type which employ opening or other fibre processing rollers, of which the most common example is probably the carding machine itself.

In the conventional carding machine, one card-clothed roller co-operates with another similarly clothed roller or else with a set of card-clothed moving flats. However, there have been stationary (in the sense of non-rotating) elements even in well known carding and other fibre opening machines. For example, some fibre opening machines employ feed plates over which the material travels, there being a feed roller co-operating with the feed plate, the feed roller being smooth, fluted or card-clothed. In recent years, there have been proposals to use stationary arcuate card-clothed plates co-operating with a card-clothed cylinder, these plates taking the place of the conventional worker and stripper arrangement or moving flats, and this type of plate represents another stationary element. Further, it has been proposed in our co-pending U.S. Pat. application Ser. No. 488,818 filed July 15, 1974, to remove a carded web of fibres from a rotating member (such as a doffer in a carding machine) by passing the web through a mouth formed between a rotating element and a non-rotating element.

Thus non-rotating elements are known at the feed stations, the carding station and the doffing station of a carding machine. The invention is, more specifically, concerned with such non-rotating elements, but it is to be understood that the invention is not restricted to carding machines, and that it includes not only fibre processing machines, but also non-rotating assemblies for use in such machines.

The basic problem which the invention sets out to meet is that where a roller in a fibre processing machine co-operates with a non-rotating element, it is necessary to attempt to ensure that the setting of the non-rotary element relatively to the roller is constant across the width of the machine. This is often quite difficult.

Taking for example, the feed plate, this is subject to inherent strains and to deflection caused by pressure of the feed roller (which itself is subject to deflection). It is usual when fitting the feed plate to file the locating surfaces where the plate is supported on the machine frame in an attempt to compensate for deflection, using a feeler gauge in an attempt to obtain a nearly constant clearance between the plate and the roller. This is a time consuming operation.

As for the stationary carding plates, it is the practice to mount the card-clothing on relatively thick, and therefore rigid plates. When such plates are used especially on wide cards, it is common to find that there are considerable variations in the setting of the teeth across the width of the machine. Hence the carding action is not as even as desirable.

According to one aspect of this invention an assembly for use in a fibre processing machine in association with a rotary element of the machine comprises a non-rotary element elongate in the transverse direction having regard to its eventual orientation in the machine, and a series of at least three individual mounting arrangements situated at transversely spaced positions, at least one of the mounting arrangements being connected to the non-rotary element so as to be capable of use to adjust the relative displacement between the part of the non-rotary element in the region of the mounting arrangement, and the rotary element when the assembly is in position on the machine.

According to another aspect of the invention a fibre processing machine includes a rotary element with which there is associated a non-rotary element, both the rotary and the non-rotary elements extending transversely of the machine, there being a series of at least three individual mounting arrangements for the non-rotary element, situated at transversely spaced positions and at least one of the mounting arrangements being capable of adjustment to regulate the relative displacement of the rotary element and the part of the non-rotary element in the region of that mounting arrangement.

Preferably all the mounting arrangements are capable of adjustment, and in the preferred arrangement, each adjustable mounting arrangement comprises an extensible device adapted to act between the non-rotary element and a part of the machine frame or a part carried by that frame.

According to another aspect of this invention, a feed plate for use with a fibre processing machine is provided with one or more jacks which can be used to apply loads to the plate to exercise control on the feed of material between the feed plate and a feed roller. The jack or jacks may be adapted to regulate the width of the gap between the plate and the feed roller. Thus the jack or jacks can be used for example, to compensate for distortion of the plate due to its own weight or due to applied loads.

It is to be understood that the term "jacks" is used in a very broad sense and could include purely mechanical devices or pneumatic or hydraulic devices.

The provision of the jack or jacks enables the feed plate to be supported from the ground or from relatively massive parts of the machine structure, which massive parts are less susceptible to deflection than the feed plate itself, although it is not essential that the support structure shall not deflect, so long as it is sufficiently rigid to ensure that the feed plate itself will sustain deflection when the jacks are operated.

In its most elementary form the invention provides a single jack, sited approximately midway along the length of the feed plate (this length extending transversely of the machine when the feed mechanism is in position) so that the feed plate can be mounted in conventional manner on supports forming part of the machine, near to its ends, whereby the feed plate becomes a simply supported beam, and then the single jack can be used to apply a counterthrust at the position of maximum deflection of the plate, with the aim of cancelling any deflection of the plate due to bending. In practice, such as elementary arrangement might not be particularly effective, since, although it would certainly minimize the maximum deflection, it might produce an undulation along the length of the plate. Furthermore, the feed plates often have considerable width, and it is desirable to be able to rectify lateral as well as longitudinal deflections of the plate.

According to a preferred feature of this aspect of the invention therefore, a plurality of jacks is provided at positions spaced apart along the length of the plate. There may be two or more rows of jacks each row extending longitudinally and the rows being spaced from each other laterally of the plate. In the preferred arrangement, each jack comprises a pillar, acting as a strut supporting the feed plate from beneath, and having a screw-and-nut arrangement for varying its effective length.

According to another preferred feature of this aspect of the invention a textile fibre processing machine has a feed plate at least partially supported by one or more jacks capable of applying a load to the feed plate to oppose deflection of that plate due to its own weight or applied operational loads. Preferably there is a series of jacks at positions spaced apart from each other along the length of the feed plate (i.e. across the width of the machine).

In a preferred arrangement, a textile carding machine has a feed plate supported by a series of jacks spaced apart along the length of the plate, each jack comprising a strut arranged between a massive part of the machine structure and the feed plate, and having a screw-and-nut arrangement whereby the effective length of the strut between the massive part and the feed plate can be adjusted.

According to yet another aspect of the invention a stationary carding plate assembly comprises a relatively rigid frame adapted to be secured at or near its ends to stationary parts of a carding machine whereby the frame can bridge part of the machine occupied by the swift or cylinder, an arcuate plate for supporting the card-clothing or other carding media on its concave side, and at least three mounting devices attaching the plate to the frame at positions spaced apart across the width of the assembly. It will be appreciated that with such an assembly two functions which would otherwise conflict with each other have been separated so that:

the rigidity desirable to minimise setting variations is supplied by the frame, and the capability of formation into an arcuate shape is supplied by the plate itself.

According to another aspect of the invention a stationary carding plate is resilient in a direction substantially perpendicular to the card-clothed surface, and has a series of at least three adjustable mounting devices arranged at spaced positions on the plate, each mounting device being adapted to produce adjustment of an area of the plate in the region of that device as permitted by the resilience of the plate.

According to a preferred feature of the invention, these two latter aspects of the invention are combined, that is to say a stationary carding plate assembly comprises a relatively rigid frame adapted to be secured at or near its end to stationary parts of a carding machine whereby the frame can bridge the part of the machine occupied by the swift or cylinder, an arcuate plate for supporting the card-clothing or other carding media on its concave side, the plate being resilient in a direction perpendicular to the card-clothed surface, and a series of mounting devices arranged at spaced positions on the plate and connecting the plate to the frame, each mounting device being adapted to produce adjustment of an area of the plate in the region of that device as permitted by the resilience of the plate.

Preferably each adjustable mounting device has clamping elements adapted to engage in opposite sides of a substantially rigid bearer (which may form part of the frame) adapted to be secured to the machine frame, the clamping elements acting substantially in the direction of permitted adjustment of the plate. One form of clamping element is a screw-and-nut mechanism, and another is a compression spring. In the preferred arrangement each mounting device comprises oppositely acting screw-and-nut and spring elements.

According to another preferred feature of the invention each adjustable mounting device incorporates a resilient element (which may be the compression spring clamping element) adapted to permit flexing of the region of the plate adjacent to that mounting device away from the cylinder or swift with which it co-operates. This enables regions of the plate to move relatively to the swift or cylinder to allow larger than normal lumps of material being carded to pass without damaging the card-clothing.

In a preferred construction the rigid frame comprises a pair of parallel rods each of which is supported near to each end from the bends of the carding machine, so that the two rods extend across the width of the machine, and the plate is carried on a series of spaced mounting blocks each of which carries a pair of brackets which engage respectively over the two parallel rods, there being a compression element acting between the underside of each rod and the block, and a screw-and-nut device acting between the top side of each of the parallel rods and its associated bracket.

The invention has been found to be particularly useful with a stationary carding plate of the type described in the U.K. Specification of Patent Application No. 46295/73.

According to a still further aspect of the invention a web stripping assembly for use in a fibre processing machine comprises a rotary stripping roller and a non-rotary blade pressed towards the surface of the stripping roller, there being at least three setting adjusting means acting on the blade whereby it is possible to effect localised adjustment of the setting of part of the blade in the region of each adjusting means relative to the stripping roller.

A carding machine incorporating three forms of apparatus each in accordance with the invention will now be described by way of examples only.

In the accompanying drawings:

FIG. 1 is a section through a first feed mechanism,

Figure 4:
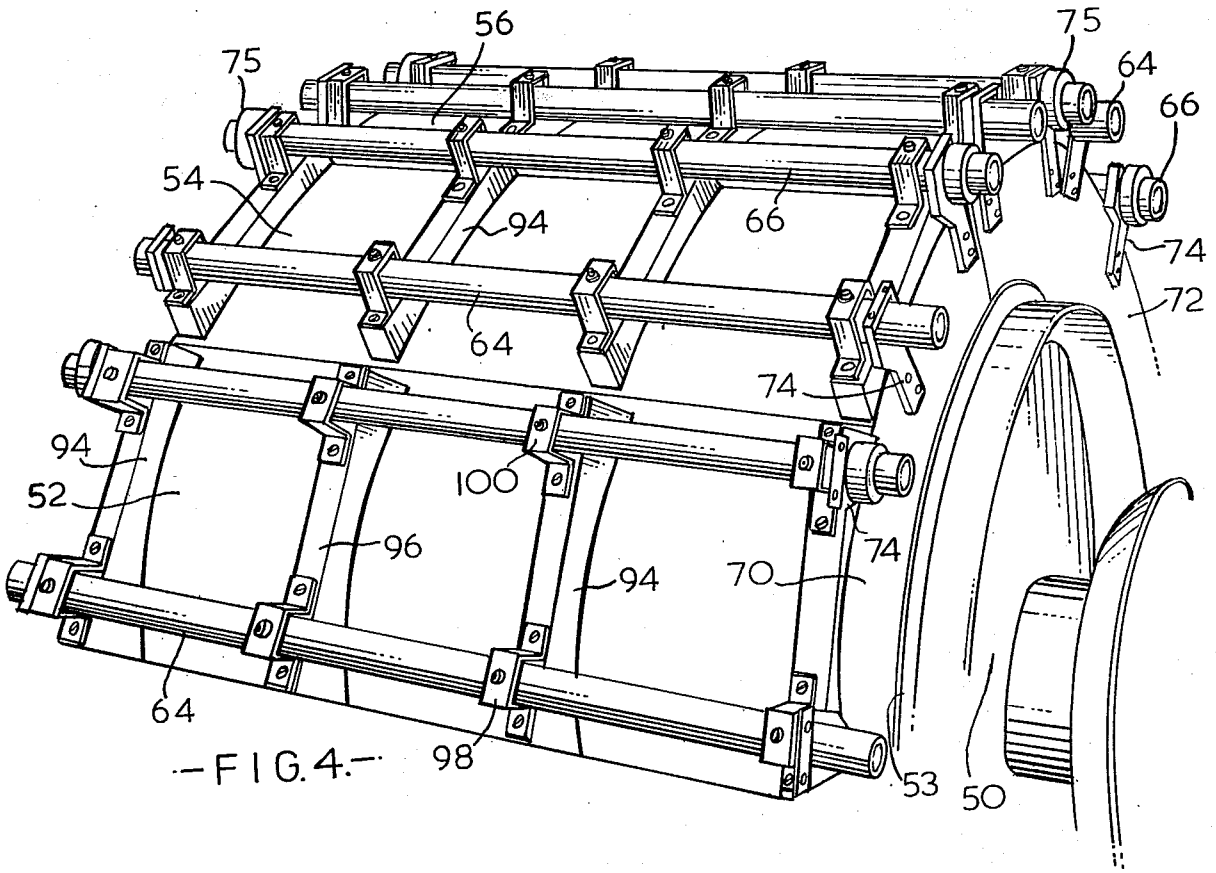
Figures 5, 6:
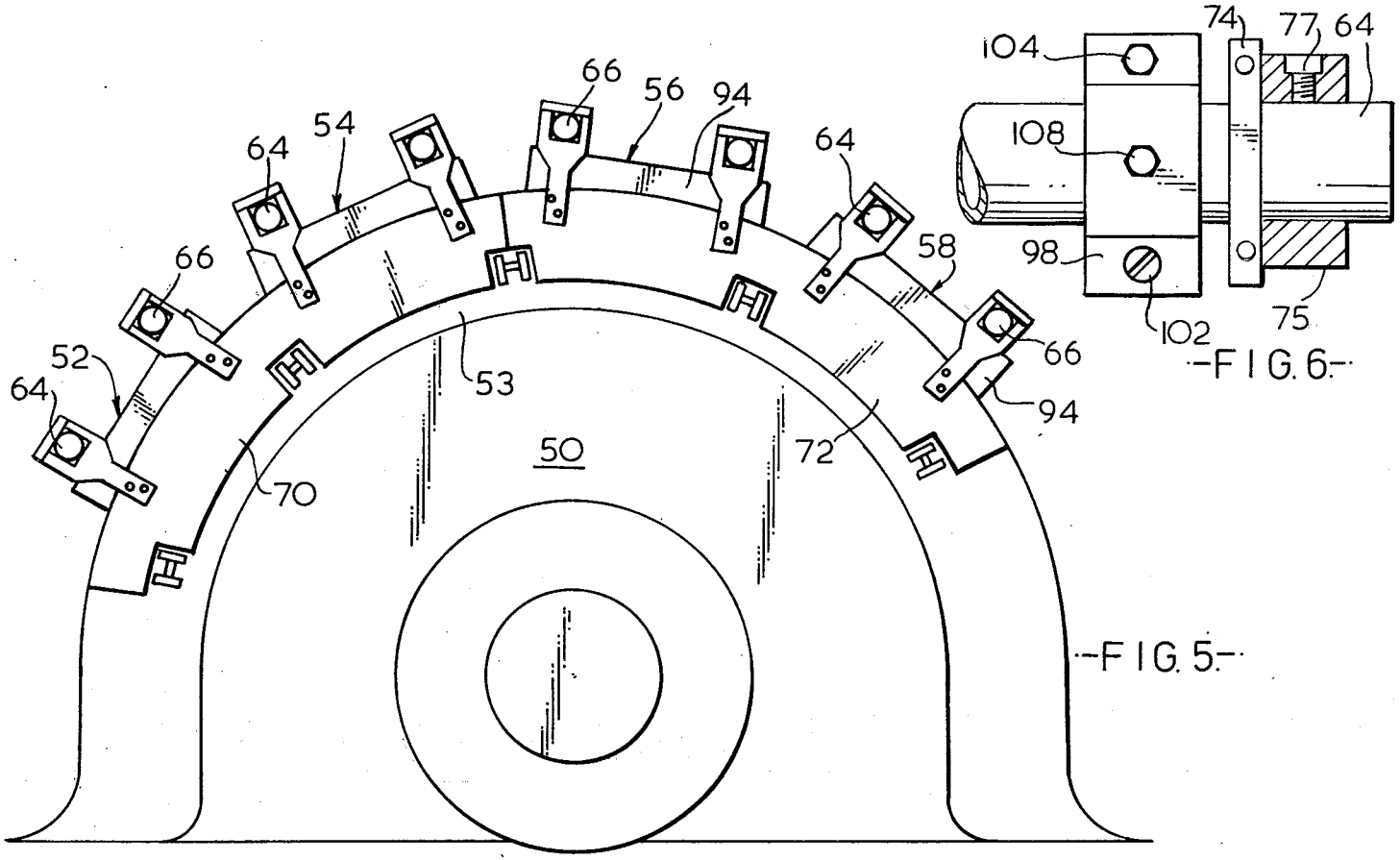
Figure 9:
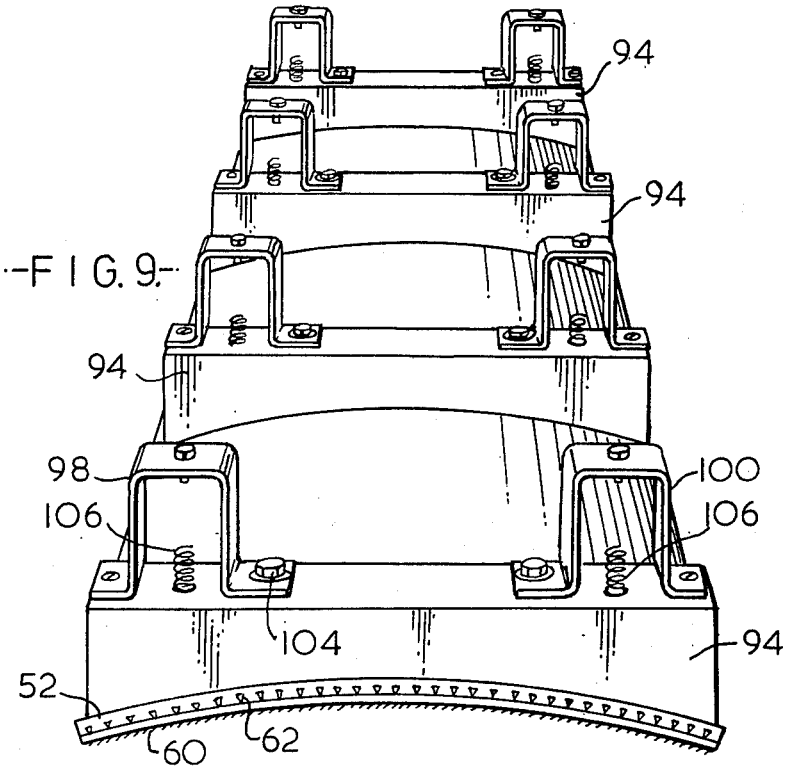
Figure 10:
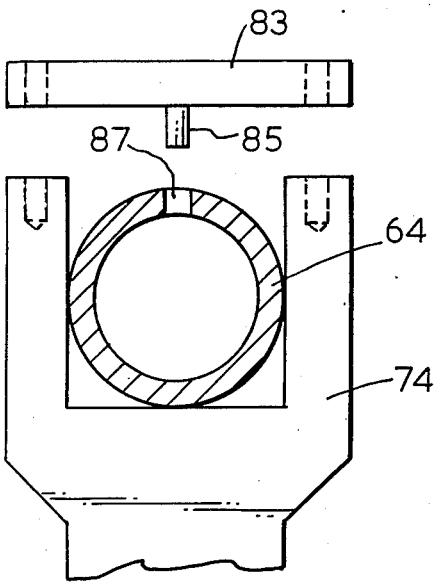

FIG. 3 is a section similar to FIG. 1, but showing an alternative feed mechanism, FIG. 4 is a perspective view of the cylinder and associated parts of a carding mechanism, FIG. 5 is an end view of the cylinder shown in FIG. 4, FIG. 6 is a detail view of a mounting arrangement for a support rod, FIG. 7 is a detail view of a mounting bracket, FIG. 8 is a cross-section through a stationary carding plate assembly, FIG. 9 is a perspective view of a carding plate removed from the machine, FIG. 10 is a detail view partly in section similar to FIG. 7, but showing a locating device, FIG. 11 is an end view, part in section, through a doffing apparatus for a carding machine, and FIG. 12 is a detail view to a larger scale of part of the apparatus shown in FIG. 11, looking in the direction of the arrow XII.

Figure 2:
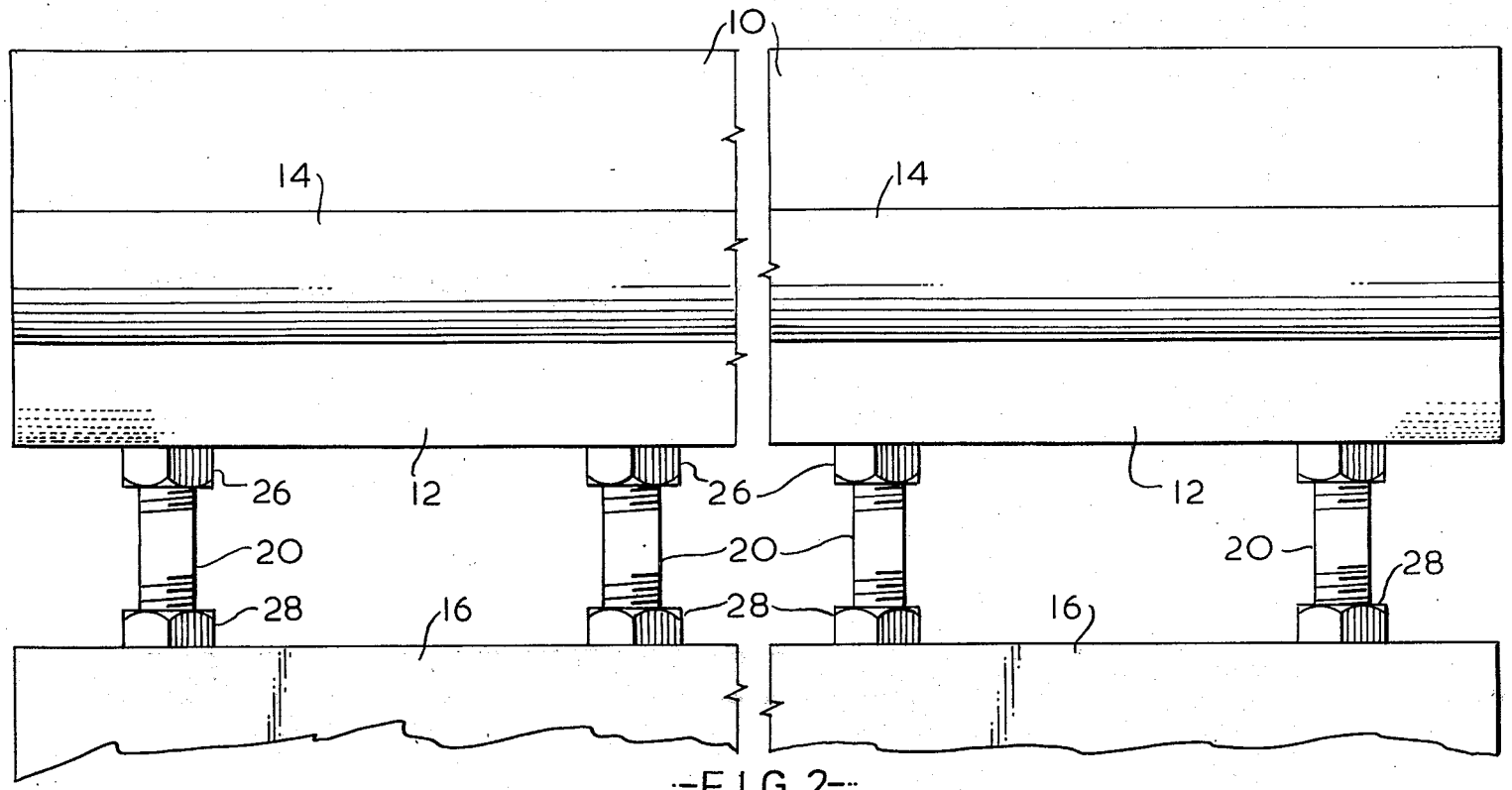
FIG. 2 is a view looking in the direction of arrow II in FIG. 1.

In FIGS. 1 and 2, the lickerin roller of a carding machine is shown at 10, a feed plate at 12 and a feed roller at 14. Since these parts form known features of many carding machines, it is not necessary to describe them in detail. The rollers 10 and 14 rotate in the directions indicated by the arrows and fibrous material delivered on to the feed plate 12 by a mechanism not shown, is dragged through the nip between the plate and the feed roller 14 to be delivered to the card-clothed surface of the lickerin roller 10.

The feed plate 12 is supported at its ends on parts of the machine side frames and consequently is a simply supported beam. In order to provide the nip between the plate and the feed roller, the latter is mounted in bearings (not shown) and loaded downwardly on to the feed plate. Thus the feed plate is subjected to bending forces due to (i) its own weight and (ii) the load applied by the weight of the feed roller 14 and the loading of that roller.

One of the problems associated with the feed plate and feed roller mechanism is that of ensuring an even feed of material to the machine, due to manufacturing inaccuracies or distortions of the plate and/or the roller.

If there are manufacturing inaccuracies, then the gap between the plate and roller may vary from that which is required for an even feed of the fibrous material at the desired rate, or the gap may vary in width, producing uneven distribution of the rate of feed across the width of the machine. In an attempt to avoid these problems, it is usual to machine the roller and the feed plate to close manufacturing tolerances, and thus increase the expense of these items.

When the feed plate and the feed roller are fitted on the machine, they are both subject to bending stresses due to their inherent weight, each being mounted on the machine as a simply supported beam. Moreover, when the machine is in operation, additional stresses arise due to pressure between the roller and the plate and these stresses can cause further deflections of the plate and/or the feed roller. Any such deflections produce variations in the gap between the roller and plate and are another cause of unevenly distributed feed of material.

For many years it has been the practice to file the end parts of the feed plate which bear upon the machine frame, in an attempt the "throw" the plate with a view to compensating for deflection. Sometimes the "throwing" is merely intended to counteract the effect of static deflection, and sometimes to counteract the effect of working stresses. In any case, it will be appreciated that the filing is a highly skilled and time consuming operation which adds greatly to the cost of installation. The problem increases in severity as wider carding machines are employed.

The the purpose of the present invention, a relatively massive stationary bed 16 is provided on the machine structure. This may be a specially provided item or it may be an existing cross-strut in the machine frame. In any event, it is preferable but not essential that the bed 16 shall be capable of withstanding loads of the magnitude sustained by the feed plate 12, with little or no detectable deflection.

The feed plate is supported from the bed 16 by a series of jacks 18. These jacks are arranged in two rows R and F, there being say four equally spaced jacks in each row. The rows R and F are spaced from each other laterally of the plate 12 in the direction of travel of the fibres, so that R is the rear row and F the front row. Thus, all regions of the feed plate rests on the jacks.

Each jack consists of a stud 20 of substantial proportions, the top end of the stud being received in a clearance hole 22, in the underside of the plate 12 and the lower end of the stud being received in a similar clearance hole 24 in the top of the bed 16, and a pair of nuts 26 and 28. The nut 26 engages on a screw-threaded part of the stud 20, and the plate 12 rests on this nut; the nut 28 engages on another screw-threaded part of the stud and this nut bears on the bed 16. Consequently, the effective length of the jack is the distance between the underside of the nut 28 and the topside of the nut 26. If it is required to adjust this length then one nut must be held and the other rotated, so that either the stud turns in the stationary nut or the rotating nut turns on the stud, or both. If the studs are locked against rotation then it is still possible to vary the effective length of the jack by turning one or both nuts.

When the feed plate and the roller are fitted on the machine, the deflections are measured by feeler gauges inserted between the feed plate and the feed roller and then the jacks are adjusted as required to bring the top surface of the plate 12 to a uniform setting from the feed roller. The distribution of the jacks enables local distortions to be compensated for as well as the major deflections of the plate.

FIG. 3 shows an alternative arrangement, in which the lickerin roller 30, feed plate 32, feed roller 34 and bed 36 are identical with the equivalent parts shown in FIG. 1, but the construction of the jacks is different.

Each jack comprises a stud 38, which is screwed into a tapped hole 40 in the underside of the plate 32. A screw-threaded lower part 42 of the stud passes through a clearance hole 44 in the bed 36, and there are nuts 46 and 48 engaged on the screw-threaded part 42 and abutting respectively against top and bottom surfaces of the bed 36.

To adjust the effective length of a jack it is only necessary to slacken one of the nuts 46 and 48 and then to tighten the other.

Passing on now to the carding arrangement which is illustrated in FIGS. 4 to 9, the carding machine which is shown is a cotton type card, wherein there is a single card-cylinder 50 (see FIG. 5). At each side of the cylinder there is a metal bend 53 which forms part of the stationary framework of the machine. It is customary to have a set of moving card-clothed flats over the upper part of the cylinder 50, but in the present instance, these are replaced by a set of four stationary card-clothed arcuate plates 52, 54, 56 and 58.

Each plate 52, 54, 56 or 58 is so formed that it is concentric with the axis of rotation of the swift or cylinder 50. Card-clothing 60 (see FIG. 8) — which may be of the flexible or metallic wire type — is applied to the concave surface of the plate and, in use, this card-clothing co-operates with the card-clothing 61 on the cylinder 50 to provide the carding action. The plate itself is made of timber and in order to give it the necessary degree of flexibility to allow it to be bent to the contour of the card-clothing, a series of saw-cuts 62 is formed in the inside of the wood sheet, each cut extending longitudinally of the sheet (i.e. parallel to the axis of rotation of the swift 50). The timber sheet is bent to the required arcuate form, and the bending operation causes each of the saw-cuts to partially close so that it is of Vee-shaped cross-section. Resinous material in fluid form is applied all over the concave face of the timber sheet, and allowed to flow into each of the saw-cuts of the timber sheet. The card-clothing 60 is secured to the timber sheet by the resin, and when the resin sets, it prevents the Vee grooves opening, thus holding the timber sheet in the bent, arcuate form. This provides the necessary rigidity for the card-clothed element, but it will be appreciated that by virtue of the fact that the plate is basically made of timber, it does have a certain amount of resilience, particularly in radial directions relatively to the axis of rotation of the swift 50.

It will be appreciated, that the plate 14 described above, is made in accordance with one of the methods described in the U.K. Specification of Patent Application No. 46295/73, but that it could in fact be made of any of the other methods described in that specification.

For the purpose of mounting the stationary plate on the carding machine, a relatively rigid frame is provided, and this baiscally takes the form of two tubular rods 64 and 66, extending across the width of the machine, and projecting somewhat beyond each of the bends 53. The tubular rods 64 and 66 are of substantial proportions, and are made in steel, so that normal operating loads encountered during the carding action, are insufficient to produce any appreciable deflection of these rods.

At each side of the machine, the customary flexible bends are removed, and replaced by two rigid curved plates 70 and 72 which are secured to the fixed bend 53. A mounting bracket 74 is provided at each end of each rod 64 or 66, and this bracket is secured to the plate 70 or 72 as the case may be, by set screws passed through slots 76 and 78 in the lower part of the bracket (see FIG. 7) these set screws engaging in screw-threaded holes in the plates 70 and 72. The slots 76 and 78 permit some adjustment of the bracket in a radial direction relatively to the axis of rotation of the cylinder 50. The permitted adjustment of each pair of brackets 74 which are associated with one end of one of the carding plates 52, 54, 56 and 58 is in a direction parallel to a radius passing through the centre of the width of the plate.

The upper part of each mounting bracket 74 is bifurcated, and the end of the rod 64 or 66 rests on the flat bottom of an open-topped slot 80. The top of this slot 80 is closed by a cap 82, which bridges the slot and is secured to the limbs of the bifurcated portion by screws 84 and 86. A powerful compression spring 88 is located between the top of the rod 64 and the underside of the cap 82, this spring normally holding the rod in its lowest position in the slot 80 as illustrated. However if a large lifting force is applied to the rod 64, then the compression spring 88 will yield to allow the rod to rise slightly. In some instances, it may be desirable to prevent any lifting of the rod 64, in which case, a stop screw 90, shown in chain dotted lines in FIG. 7, and engaged in a screw-threaded hole in the cap 82 is secured into engagement with the top of the rod 64 and then locked by a nut 92.

A method of locating the rod 64 angularly with respect to its own longitudinal axis and axially, is shown in FIG. 10. The mounting bracket 74 is identical with that shown in FIG. 7, but its cap 83 is provided with a depending peg 85, which is a close fit within a radial hole 87 in the rod 64. It is only necessary to provide a peg 85 at one end of the rod 64, and in practice, the hole 87 will be drilled, and the peg 85 fitted on the machine when the carding plates are being fitted.

If the carding plate assembly including the rods is removed from the machine, then when it is replaced, the location of the pegs 83 in the holes 87 will ensure that the rods 64 and 66 occupy the same position relatively to the cylinder or swift that they did previously and hence the adjusted positions of the carding plates relatively to the cylinder or swift will remain the same as previously. A spring such as the spring 88 can be used with the locating arrangement shown in FIG. 10.

At a series of spaced apart positions across the width of the timber plate 52, 54, 56 or 58 there are provided timber blocks 94 which are secured to the plate, by screws and/or adhesive. Each of these blocks 94 is arcuate on its inside edge, to conform to the convex shape of the outer face of the plate 52, 54, 56 or 58, but its outside edge 96 is straight, and presents a surface which is tangential to an arc drawn about the axis of rotation of the cylinder 50. A pair of metal brackets 98 and 100 is provided on each of the blocks 94, each of these brackets being secured to its block 94, by a screw 102 and a bolt and nut 104 (see FIG. 8). The brackets 98 and 100 and their associated parts are identical, so that it is only necessary to describe one in detail, and it will be observed from FIGS. 4 and 8, that the tubular rods 64 and 66 are received within the brackets 98 and 100 respectively.

A powerful compression spring 106 is located on a hole 108 formed in the block 94, beneath the brackets 98 or 100, and this compression spring acts between the block 94 and the rod 64 or 66. An adjusting screw 108 passes through a screw-threaded hole in a bridge portion of the bracket 98 or 100, and engages with the top side of the rod 64 or 66, the adjusting screw being locked in any preselected position, by means of a lock nut 110.

A collar 75 is secured by a grub screw 77 on each end of one of the rods 64 and 66, of each pair, this collar abutting the outer face of the adjacent mounting bracket 74, as shown in FIG. 6. The collars 75 serve to locate the rods 64 and 66 together with their carding plates 52, 54, 56 and 58 laterally of the carding machine, so that the card-clothed underside of each plate is properly aligned with the cylinder 50. However, the collar 75 will not be required if pegs 83 are fitted to provide endwise location for the rods 64 and 66 and the plates carried thereon, as described with reference to FIG. 10.

It will be observed therefore, that the stationary carding plate 52, 54, 56 or 58 is suspended from the relatively rigid rods 64 and 66 and that whereas major adjustments in the positioning of the carding plate relative to the cylinder 50 can be effected by adjustment of the position of the mounting plates 74, precise positioning of the carding plate is permitted by adjustment of the screws 108, which compress the compression springs 106 to a greater or lesser extent, and thereby locate the carding plate relatively to the rods 64 and 66. Apart from the possibility of positioning the carding plate concentric with the cylinder 50, it is also possible by virtue of the permitted adjustments to position the carding plate, so that the leading or trailing end is closer to the periphery of the cylinder than the other, an arrangement which is sometimes favoured by carding engineers.

It has been found very difficult to produce an even setting of the card clothing 60 on a stationary carding plate relatively to the card-clothing on the periphery of the cylinder 50, because of the large size of the carding plate, and in particular because of the width which it has to bridge between the bends of the carding machine. However, with the arrangement described above, it is possible to make regional adjustments in the setting between the plates and the swift or cylinder, by utilising the adjustment provided by the screws 108. Thus for example, if it is found that the carding plate tends to deflect downwardly at the centre of its width, then the screws 108 on the brackets 98 and 100 adjacent to the central area, can be tightened to a greater extent than those towards the bends, so that the central part of the plate is deflected upwardly, to compensate for its natural downward deflection. In fact, it is even possible to provide for even more localised deflection of the carding plate, to compensate for some irregularity in manufacture.

Moreover, during a carding operation, if an excessively thick piece of material enters the space between the cylinder and the carding plate, then it is possible for that region of the carding plate to deflect slightly upwardly, as permitted by the compression springs 106, to allow the excessively thick piece of material to pass, without damage to the card-clothing or other parts of the machine.

If there is some large force applied to the underside of the plate 52, 54, 56 or 58 (caused for example, by some metallic object attempting to pass between the cylinder 50 and that plate), then the entire assembly of the plate, its brackets 98, 100 and its rods 64 and 66 can rise as permitted by yielding of the springs 88, to allow the obstruction to pass without excessive damage to the carding plates.

It is to be understood, that the invention is not restricted to the use of stationary carding plates made according to any particular method. In fact, the carding plates could be constructed of sheet metal, and in fact quite thin sheet metal could be used for this purpose, since the blocks 94 will give it a certain amount of strength, and in any case, any localised deflections of the plate can be compensated for by the mounting arrangement just described.

It is also to be understood, that a stationary carding plate could be supported on a single bearing rod, instead of the two bearing rods 64 and 66 described above, particularly if the carding plate itself is relatively short in the direction of curvature. Clearly of course, there may be more than two bearings rods for each plate, if the plate is quite large.

It should also be understood that instead of each carding plate extending across the full width of the machine, there could be two or more narrower carding plates of the same construction, mounted end-to-end on the pair of rods 64 and 66 (or on a single rod if desired). It is still preferable however to provide a plurality of mounting positions for each such plate to allow the plate to be deflected regionally to provide for arcuate setting of the plate relatively to the swift or cylinder.

The third form of the invention is shown in FIGS. 11 and 12, wherein there is illustrated the apparatus for removing the carded fibrous web from the usual doffer roller 112. In the conventional cotton carding machine, there is a fly comb for this purpose, but the fly comb is unsuitable for modern high production cards, because of its basic oscillatory motion.

A polygonal stripping roller 114 is situated close to the periphery of the doffer roller, and this stripping roller is rotated at a surface speed faster than that of a doffer. A flexible and resilient blade 116 is pressed against the surface of the stripping roller 114, in the angle between the doffer 112 and the stripping roller. As the roller 114 rotates it causes the "free" and of the blade 116 to oscillate, thus producing the effect of an opening and closing mouth between the stripping roller and the blade. The web of fibres drawn off the doffer 112 is taken into this mouth and is then pulled forwardly by the stripping roller. This stripping mechanism has been found to be particularly effective and its action is described in the Specification of U.S. Pat. application Ser. No. 488,818.

With such a stripping mechanism, there is a problem of maintaining an even grip on the fibre web across the width of the machine, and in this connection it should be understood that on wide carding machines the web may be three meters wide, so that there are real problems due to deflection and possible misalignment of parts of the web-removing apparatus. It is to be understood however that the arrangement shown in FIGS. 10 and 11 can be used on machines of any width.

An angle iron support 118 extends across the width of the machine and is fixed to the machine frame. At a series of positions spaced transversely across the machine, there are pairs of lugs 120 fixed to the support 118, and each pair of lugs mounts an axle 122 on which a setting lever 124 is pivoted. A carrier rod 126 — which must have some degree of resilience — is secured to the upper ends of the setting levers 124, and bridges all these levers as indicated in FIG. 12. A deep groove is formed throughout the length of the carrier rod, and this groove receives the bottom edge portion of the blade 116. Fastening screws 128 are, if necessary, provided to secure the blade in position. By virtue of this arrangement it is possible to remove and replace the blade quite easily if it becomes worn or requires attention.

Each lever 124 has an adjusting screw 130, which passes through a clearance hole in the lower part of the lever, and engages in a screw-threaded hole in the support 118. A compression spring 132 engages between the upright part of the support 118 and the lower part of the lever 124, urging the latter in an anti-clockwise direction as seen in FIG. 11 (i.e. tending to pull the blade 116 away from the stripping roller).

When the apparatus is set for working, each screw 130 is tightened to press its lever 124 against the spring 132, so as to press the blade 116 with the required force against the periphery of the stripping roller 114. By virtue of the fact that there is a series of levers 124, these can be adjusted independently of each other, if necessary deflecting the carrier rod 126 to ensure an even pressure of the blade 116 against the stripping roller across the width of the machine. If the apparatus is of the type in which there is a gap between the blade and the stripping roller, then the adjustment permits the carrier rod to be deflected as required to provide an even gap.

Three non-rotary elements have been particularly described above, namely the feed plate, the carding plates and the stripping blade. It is to be understood however that the basic concept of the invention can be applied to any other non-rotary part of a fibre processing machine. For example, the undercasing of a carding machine which fits close to the underside of the cylinder or swift can be made flexible and provided with individually adjustment mountings similar to those described with reference to the feed plate or the carding plates. Such an arrangement will allow the undercasing to be adjusted as required to control the air currents.

What is claimed is:

1. In a fibre processing machine: a rotary feed roller; a fibre feed plate positioned with at least part of its operative surface adjacent to the surface of said feed roller; said feed plate being capable of a predetermined degree of deflection towards and away from said feed roller; and means for adjusting the relative displacement between the feed plate and the rotary feed roller comprising a series of individual supports arranged in at least two rows, each row including at least three supports for said feed plate spaced apart in a direction longitudinal of said feed plate, at least an intermediate one of said supports in each row comprising a jack which applies deflecting loads to said feed plate to deflect said feed plate to a predetermined degree for the purpose of controlling the spacing of the roller and plate, thereby exercising control over the feed of fibrous material between said feed plate and said feed rollers.

2. A fibre processing machine as claimed in claim 1, in which each jack comprises a pillar, acting as a strut supporting the feed plate from beneath, and having a screw-and-nut arrangement for varying its effective length.

3. A fibre processing machine as claimed in claim 1, said machine further comprising a massive part beneath said feed plate, each of said jacks comprising a strut arranged between said massive part and said feed plate and having a screw-and-nut arrangement whereby the effective length of the strut between said massive part and said feed plate can be adjusted.

4. An assembly for use in a fibre processing machine, in association with a rotary element of the machine, comprising: a non-rotary deflectable plate and means for adjusting the relative displacement between the plate and the rotary element of the machine comprising a series of individual mounting arrangements arranged in at least two rows, each row extending transversely of the plate, there being at least three mounting arrangements in each row at transversely spaced positions, at least an intermediate mounting arrangement in each row being connected to the plate so as to deflect the plate to a predetermined degree and thus adjust the relative displacement between that part of the plate in the region of each mounting arrangement and the rotary element.

5. An assembly for use in a fiber processing machine as claimed in claim 4, wherein each said intermediate arrangement in each row is adjustable in opposite directions to deflect said plate towards and away from said rotary element.

* * * * *